US005495930A

United States Patent [19]

Lenander et al.

[11] Patent Number: 5,495,930

[45] Date of Patent: Mar. 5, 1996

[54] COIN-DEPOSIT LOCK

[75] Inventors: Aage Lenander, Rungsted Kyst; Bertil Engströ, Graested, both of Denmark

[73] Assignee: Catena-Systems APS, Denmark

[21] Appl. No.: 318,827

[22] PCT Filed: Apr. 28, 1993

[86] PCT No.: PCT/DK93/00141

§ 371 Date: Oct. 13, 1994

§ 102(e) Date: Oct. 13, 1994

[87] PCT Pub. No.: WO93/22750

PCT Pub. Date: Nov. 11, 1993

[30] Foreign Application Priority Data

May 1, 1992 [DK] Denmark ..... 0573/92

[51] Int. Cl.[6] ..... G07F 7/00

[52] U.S. Cl. ..... 194/212; 194/247; 194/905

[58] Field of Search ..... 194/212, 247, 194/351, 905

[56] References Cited

FOREIGN PATENT DOCUMENTS 145550 5/1982 Denmark .
145952 5/1982 Denmark .
8201950 6/1982 WIPO .
9007167 6/1990 WIPO .
8201951 6/1994 WIPO .

*Primary Examiner*—F. J. Bartuska
*Attorney, Agent, or Firm*—Silverman, Cass & Singer, Ltd.

[57] ABSTRACT

A coin-deposit lock to be placed on a trolley being part of a row of mutually connected e.g. shopping trolleys or baggage trolleys comprises a main slide being longitudinally slidable against the force from a spring and a measuring slide likewise longitudinally slidable against the force from a second spring. Each of the slides has a transverse central aperture, and when a coin of a certain value (diameter) has been inserted between the slides, the apertures are mutually aligned. Upon insertion of a key belonging to the lock in a first key opening in the lock, the slides can be moved to a position in which a latching finger on a pivotable release member engages in the mutually aligned apertures and retains the slides and the coin between them in a withdrawn position. At the same time, the release member pivots to a position, in which a second latching finger on it frees a second key associated with a previous trolley in the row thus freeing the trolley from the row.

9 Claims, 2 Drawing Sheets

COIN-DEPOSIT LOCK

TECHNICAL FIELD

The present invention relates to a coin-deposit lock, said lock being adapted to be placed on a trolley and being of the kind set forth in the preamble of claim 1.

BACKGROUND ART

Coin-deposit locks of this kind are e.g. disclosed in the DK Published Applications Nos. 145,550 and 145,952, and the International application No. WO 82/01950, being included herein by reference. These coin-deposit locks suffer from the disadvantage that they are not especially selective with regard to the size and hence the value of the coin having been inserted, for which reason they are less suitable for achieving the purpose of such coin-deposit locks, viz. to ensure that the trolley is returned and connected to the row of trolleys, to which it belongs, so that the amount deposited is returned.

DISCLOSURE OF THE INVENTION

On the above background, it is the object of the present invention to provide a coin-deposit lock of the kind referred to above, said lock being adapted to sense the size and hence the value of the coin having been inserted, and which only releases the trolley from the row of trolleys, if the inserted coin has the correct size.

This object is achieved with a coin-deposit lock additionally exhibiting the features set forth in the characterizing clause of claim 1.

If, with this arrangement, the coin having been inserted has a larger diameter than the correct coin (provided that it is at all possible to insert the coin in the coin-insertion opening) or a smaller diameter than the correct coin, then the first latching member on the release member cannot engage in the through-going apertures in the main slide and the measuring slide, and the release member cannot pivot towards its first position and release the second key belonging to a preceding trolley in the row from the second key opening so as to liberate the trolley from the row of trolleys. Then, the wrong coin having been inserted will simply be returned to the coin-insertion opening when the first key is again removed from the first key opening. Solely when a coin of the correct size is inserted into the coin-insertion opening, the second key will be freed from the coin-deposit lock and the first key will be retained in the lock.

Admittedly, parts of the features set forth in the characterizing clause of claim I are disclosed in the DK Published Application No. 163,387, but this publication relates to a coin-deposit lock of a different kind from the one set forth in the preamble of claim 1, as this known coin-deposit lock has only one single key opening adapted to receive and retain a key belonging to a preceding trolley in a row of trolleys, said key being freed from the key opening upon insertion of a suitable coin in the lock and depressing an operating head. This known coin-deposit lock, which incidentally in the embodiment shown and described is adapted to accept coins of two different sizes, suffers from the conspicuous disadvantage that the key chained to the lock itself or to the trolley, to which it is secured, has to be chained with a chain, that is too short to allow this key itself to be introduced in the key opening of the lock to free the coin having been inserted. In this case, the effect to be achieved with the lock would, of course, be lost, since a user of the trolley could free the deposited coin as she or he pleases and without the trolley having been returned to the row of trolleys and chained to a preceding trolley. The short chain length, which is necessary in such a case, will on the other hand make it extremely difficult to connect the trolley to a preceding trolley in the row of trolleys by inserting its associated key in the key opening, for which reason this known coin-deposit lock can at best be considered as not being very practical. These disadvantages are avoided completely with the coin-deposit lock according to the present invention, with which the length of the chain connecting the first key to the lock may be choosen freely to suit the chaining-together of the trolleys in the row, and with which the first key is to be inserted in the lock in order to free the second key and hence free the trolley from the row of trolleys.

Advantageous embodiments of the coin-deposit lock according to the present invention, the effects of which will be evident from the following detailed portion of the present specification, are set forth in claims 2–9.

BRIEF DESCRIPTION OF THE DRAWINGS

In the following detailed portion of the present specification, the present invention will be explained in more detail with reference to the exemplary embodiment of a coin-deposit lock according to the invention shown in the drawings, in which.

DESCRIPTION OF THE PREFERRED EMBODIMENT

Figure 1:
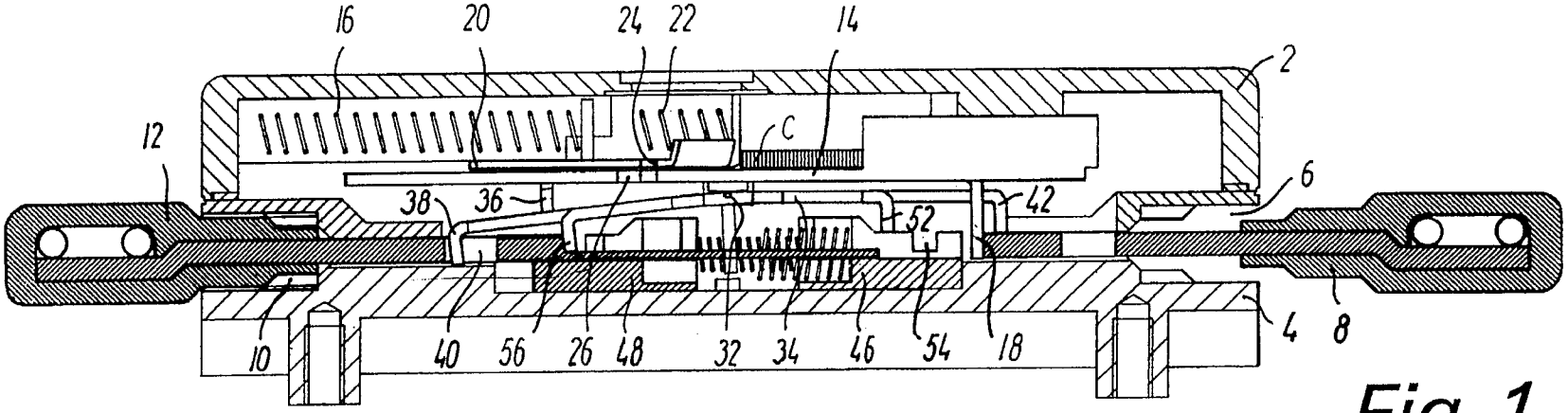
FIG. 1 is a vertical sectional view through a coin-deposit lock according to the invention in a situation, in which a coin has been inserted in the lock and the first key is being inserted in the first key opening or keyhole, whilst the second key is still being retained in the second key opening or keyhole.
Figure 2:
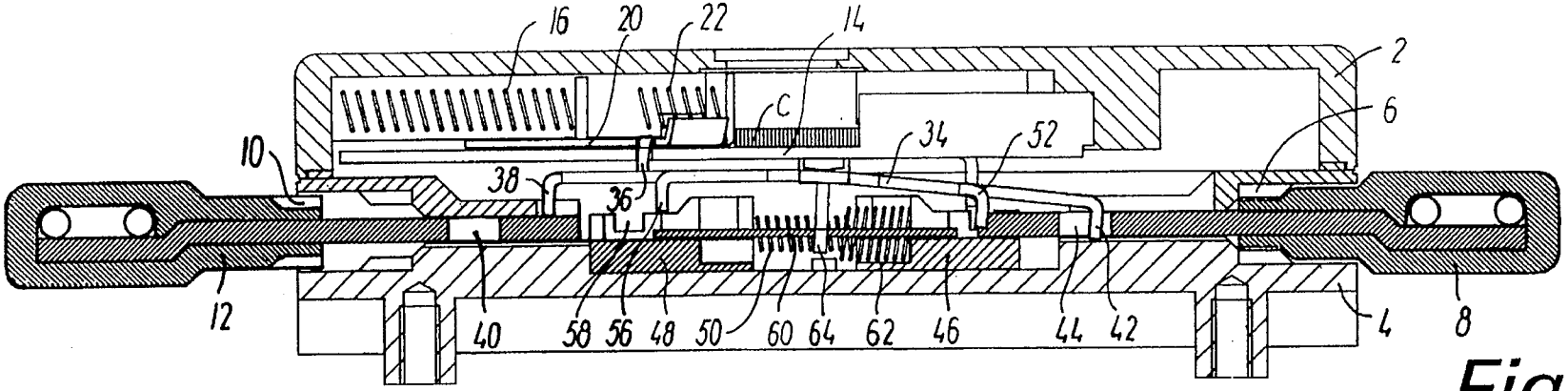
FIG. 2 is a sectional view corresponding to the view shown in FIG. 1, but with the first key completely inserted and the second key freed, FIG. 3 diagrammatically shows the coin-deposit lock according to the invention as seen from above with certain parts removed in order to show a coin in the retained position, and FIG. 4 corresponding to FIG. 3, but still more diagrammatically, illustrates the return movement of a coin from the retained position towards the coin-insertion opening.
Figure 3:
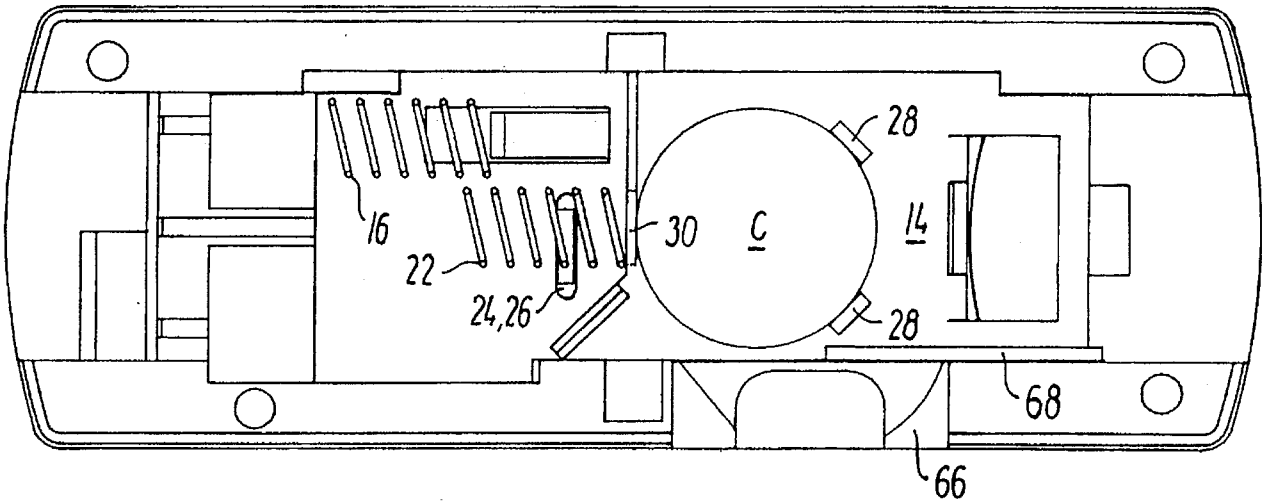

As shown in FIGS. 1 and 2, the coin-deposit lock according to the invention comprises a housing consisting of two housing parts, viz. an upper housing part 2 and a lower housing part 4. In right-hand side of the Figures, the housing is provided with a first keyhole 6 for receiving a first key 8 associated with the coin-deposit lock, whereas in the left-hand side of the Figures, the housing is provided with a second keyhole 10 for receiving a second key 12, connected by a chain to a corresponding coin-deposit lock on a preceding trolley in a row of trolleys. A main slide 14, preferably situated in the upper housing part 2, is slidable in the longitudinal direction of the housing and biased towards the right in the Figures by a spring 16. The main slide 14 has a downwardly protruding part 18 adapted to abut against the front edge of the first key 8. Situated above the main slide 14 and likewise slidable in the longitudinal direction of the housing there is a measuring slide 20, biased towards the right in the Figures by a spring 22, of which—for the sake of clearness—only a part is shown in the Figures. The measuring slide 20 comprises a centrally situated aperture 24, elongated in the transverse direction, and the main slide 14 comprises a corresponding aperture 26. These apertures 24 and 26 are placed in such a manner in the measuring slide and the main slide 20 and 14, respectively, that when a coin C of the correct value, i.e. with the correct diameter, is placed between stops 28 and 30 (see FIG. 3) on the slides 14 and 20, the apertures will be in mutual alignment as shown in FIGS. 1, 2, and 3.

Below the slides 14 and 20 and pivotable about a transverse axis 32 in the housing there is a release member 34, adapted to pivot between a first position shown in FIG. 2 and a second position shown in FIG. 1. The release member 34 comprises a first latching finger 36, in the first position of the release member 34 shown in FIG. 2 engaging with the mutually aligned apertures 24 and 26 in the measuring and main slides 20 and 14, respectively, and retaining the latter, having been moved forward with the coin C lying between them to the withdrawn position shown in FIG. 2 by the first key 8. In this position of the release member 34, a second latching finger 38 on it has been moved out of engagement with an aperture 40 in the second key 12 and has freed the latter in the second keyhole 10, whilst a third latching finger 42 on the release member 34 has been brought into engagement with an aperture 44 in the first key 8, securing the latter in the first keyhole 6.

In this first position of the release member 34, the second key 12 associated with a preceding trolley in the row of trolleys is also freed, i.e. the trolley may be removed from the row of trolleys, the coin C being retained inside the coin-deposit lock.

In the second position of the release member 34 shown in FIG. 1, the trolley has been put back into the row of trolleys, and a second key 12 from a preceding trolley in the row has been inserted into the second keyhole 10, being retained by the engagement of the second latching finger 38 in the aperture 40 in the second key 12. The third latching finger 42 has been brought out of engagement with the aperture 44 in the first key 8 associated with the coin-deposit lock, and this first key 8 is freed in the first keyhole 6. At the same time, the first latching finger 36 has been disengaged from the mutually aligned apertures 24 and 26 in the slides 20 and 14, and the latter have, together with the coin C, been moved back to the starting position by the springs 22 and 16, in which position the coin C may be removed from the coin-insertion opening in the coin-deposit lock.

In the lower housing part 4 there is a first ejector 46 and a second ejector 48, slidable in the longitudinal direction of the housing and biased away from each other by springs 50, of which only one is shown in the drawing.

When the first key 8 is inserted in the first keyhole 6, the key 8 will move the first ejector 46 forward from the position shown in FIG. 1 to the position shown in FIG. 2, in which the first ejector 46 is retained by a fourth latching finger 52 on the release member 34, the finger 52 engaging in a recess 54 in the first ejector 46. At the same time, a fifth latching finger 56 on the release member 34 has been disengaged from a recess 58 in the second ejector 48, the latter under the influence of the force from the springs 50 having been moved towards the left in the Figure so as to eject the second key 12 from the second keyhole 10.

Conversely and as shown in FIG. 1, insertion of the second key 12 in the second keyhole 10 will cause the second ejector 48 to be moved towards the right in the Figure and be retained in this position by engagement of the fifth latching finger 56 in the recess 58, while the first ejector 46 is freed, the fourth latching finger 52 being disengaged from the recess 54, so that the first ejector 46 under the influence of the force from the springs 50 pushes the first key 8 out of the first keyhole 6.

Associated with the ejectors 46 and 48 there is a switching mechanism for the release member 34. As shown in FIG. 2, this mechanism consists of a small slide 60 capable of limited movement together with the ejectors 46 and 48 and being biased away from the ejector 46 by a spring 62. The slide 60 is provided with a central opening, through which protrudes a pin 64, secured to the release member 34 opposite the latter's pivoting axis 32.

Movement of the ejectors 46 and 48 in the manner described above results in a corresponding but limited movement of the small slide 60, and hence a pivoting movement of the pin 64 and with it the release member 34 from the first position shown in FIG. 2 to the second position shown in FIG. 1, and vice versa.

With certain components omitted, FIG. 3 shows the coin-deposit lock seen from above in a situation, in which the coin C has been removed from the coin-insertion opening 66 by stops 28 on the main slide 14 and moved forward so as to abut against a stop 30 on the measuring slide 20, so that the apertures 24 and 26 in the slides are mutually aligned.

It will be understood that if the coin were to have a wrong value, i.e. a different diameter, the apertures 24 and 26 would in the situation shown not be mutually aligned, and thus, the functioning of the coin-deposit lock would be blocked, as in that case the first latching finger 36 on the release member 34 would be unable to engage in mutually aligned apertures 24 and 26 and thus allow the release member 34 to pivot from the position shown in FIG. 1 to the position shown in FIG. 2 so as to free the second key 12. Then, withdrawal of the first Key 8 would cause the wrong coin to be moved back to the coin-insertion opening in a manner to be described below.

It will be noted that in the partially forward-moved position of the coin C shown in FIG. 3, an upwardly protruding edge member 68 on the main slide 14 is moved some of the way towards a position in front of the coin-insertion opening 66. In the fully forward-moved position of the coin, this edge member 68 covers the opening 66 completely.

Figure 4:
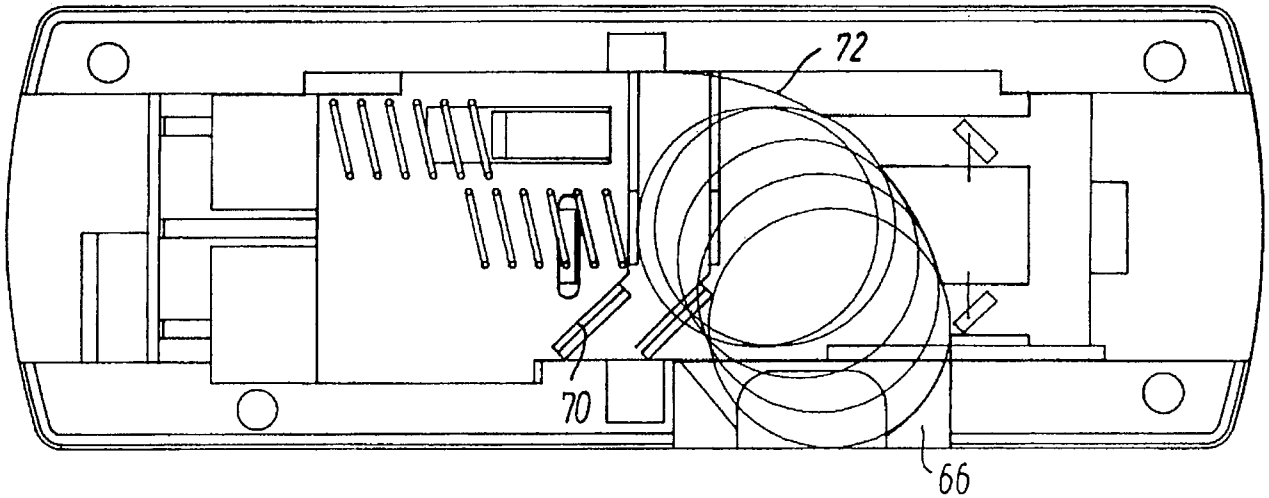

FIG. 4 shows diagrammatically how the stop 30 on the measuring slide 20 in connection with a further, oblique stop 70 on this slide together with a curved guide track 72 in the upper housing part 2 and under the influence of the force from the spring 22 will move the coin C from the position shown in FIG. 3 out into the coin-insertion opening 66, from which it may be removed by the user of the trolley.

Should a user not yet acquainted with this lock try to insert a coin in the first keyhole 6 instead of in the coin-insertion opening 66, the coin being inserted will hit the downwardly protruding part 18 of the main slide 14, possibly pushing the latter towards the left in the Figures against the force from the spring 16, the elastic force of which, when the coin is released, will move the coin back out from the first keyhole 6 without any possibility of the coin jamming or getting stuck in the first keyhole 6.

According to a preferred feature of the coin-deposit lock according to the present invention, all the keys 8 and 12 in a group of locks associated with trolleys belonging to the same set have a particular axial-symmetrical shape, at least on the part to be inserted in the keyholes 6 and 10, said shape e.g. comprising protrusions and/or recesses extending parallel to the axis of this part, each of the keyholes 6 and 10 having an axial-symmetrical shape complementary to the shape of the keys. With this arrangement, two shops situated close to each other and both using a locking system with coin-deposit locks according to the present invention can avoid getting their trolleys mixed up, provided that the two systems have mutually different shapes of the keys' and keyholes, so that trolleys with keys and keyholes corresponding to one system cannot be coupled with trolleys with keys and keyholes corresponding to the other system. The axial-symmetrical shape of the keys and keyholes makes it possible to insert the keys into the keyholes without any need for checking which side of the key faces upward.

LIST OF PARTS

C. Coin
2. Upper housing part
4. Lower housing part
6. First keyhole
8. First key
10. Second keyhole
12. Second key
14. Main slide
16. Spring
18. Downwardly protruding part
20. Measuring slide
22. Spring
24. Aperture
26. Aperture
28. Stop
30. Stop
32. Transverse axis, pivoting axis
34. Release member
36. First latching finger
38. Second latching finger
40. Aperture
42. Third latching finger
44. Aperture
46. First ejector
48. Second ejector
50. Spring
52. Fourth latching finger
54. Recess
56. Fifth latching finger
58. Recess
60. (Small) slide
62. Spring
64. Pin
66. Coin-insertion opening
68. Upwardly protruding edge member
70. Oblique stop
72. Curved guide track

We claim:

1. Coin-deposit lock to be placed on a trolley capable of being part of a row of such trolleys connected to each other, said trolleys especially being in the form of shopping trolleys and baggage trolleys, said coin-deposit lock being adapted to liberate a trolley connected to the row by the insertion of a coin of a certain value in the lock and to free the coin having been inserted when the trolley is replaced and re-connected to the row, said coin-deposit lock being of the kind comprising a coin-insertion opening (66), a pivotable release member (34) and two key openings capable of being blocked, viz. a first key opening (6) for receiving and retaining a first key (8) belonging to the coin-deposit lock and a second key opening (10) for receiving and retaining a second key (12) belonging to a corresponding coin-deposit lock on a preceding trolley in the row, characterized by the combination of a sensing means for the coin size comprising a spring-biased main slide (14) and a spring-biased measuring slide (20) and the pivotable release member (34), in which the insertion of a correct coin (C) in the coin-insertion opening (66) followed by the insertion of the first key (8) in the first key opening (6) causes the coin (C), the main slide (14) and the measuring slide (20) to be moved forward to a retained position within the lock and pivoting of the release member (34) to a first position (FIG. 2), in which a first latching member (36) on the release member (34) engages in a through-going aperture (24,26) in the main slide (14) and the measuring slide (20) and retains these slides, and a second latching member (38) on the release member (34) is disengaged from an aperture (40) in the second key (12) and frees the latter from the second opening (10), and in which re-insertion of the second key (12) in the second key opening (10) causes pivoting of the release member (34) to a second position (FIG. 1), in which the first latching member (36) frees the main slide (14) and the measuring slide (20), and the coin (C) is returned to the coin-insertion opening (66), and in which the second latching member (38) engages in the aperture (40) in the second key (12) and retains the latter in the second key opening (10), and in which the release member (34) has a third latching member (42), in the first position (FIG. 2) of the release member (34) engaging in an aperture (44) in the first key (8) and retaining the latter in the first key opening (6), and in the second position (FIG. 1) of the release member (34) being disengaged from the aperture (44) in the first key (8) and liberates the latter from the first key opening (6).

2. Coin-deposit lock according to claim 1, characterized by the main slide (14) and measuring slide (20) each having an aperture (24,26), said apertures, when a coin (C) of said certain value has been inserted between the slides (14,20), are mutually aligned and able to be engaged by the first latching member (36) on the release member (34).

3. Coin-deposit lock according to claim i or 2, characterized by further comprising a first (46) and a second (48) ejector, said ejectors being spring-biased away from each other by ejector springs (50), wherein the first ejector (46) by insertion of the first key (8) in the first key opening (6) is moved towards the second ejector (48) and retained by a fourth latching member (52) on the release member (34) in the latter's first position (FIG. 2), while at the same time, a fifth latching member (56) on the release member (34) frees the second ejector (48) so that the latter moves the second key (12) out from the second key opening (10), and wherein the second ejector (48) upon insertion of the second key (12) in the second key opening (10) is moved towards the first ejector (46) and retained by the fifth latching member (56) on the release member (34) in the latter's second position (FIG. 1), while the first ejector (46) is freed from the fourth latching member (52) on the release member (34), so that it moves the first key (8) out from the first key opening (6).

4. Coin-deposit lock according to claim 3, characterized by a slide (60) placed between the first (46) and the second (48) ejector and adapted for limited movement together with each ejector and being spring-biased (62) away from the first ejector (46), said slide (60) being engaged with a pin (64) on the pivotable release member (34) in order to switch the latter from its first position (FIG. 2) to its second position (FIG. 1), and vice versa.

5. Coin-deposit lock according to claim 4, characterized in that the main slide (14) is provided with stops (28), which upon forward movement of the main slide (14) when the first key (8) is inserted in the first key opening (6) move the coin (C) forward from the coin-insertion opening (66) to a position between said stop (28) and a stop (30) on the measuring slide (20).

6. Coin-deposit lock according to claim 5 and of the kind comprising a housing with an upper housing part (2) and a lower housing part (4), characterized by the upper housing part (2) having a guide track (72) adapted upon return movement of the main slide (14) and the measuring slide (20) and the coin (C) lying therebetween from the retained position within the lock to move the coin out towards the coin-insertion opening (66).

7. Coin-deposit lock according to, claim 6 characterized by the main slide (14) having an upwardly protruding edge member (68) adapted to block the coin-insertion opening (66) in the forward-moved and retained position of the slide in the lock.

8. Coin deposit lock according to, claim 7 characterized in that all the keys in a system of locks associated with a row of trolleys belonging to the same set, at least on the part adapted to be inserted in the key openings, has a particular axial-symmetrical shape extending parallel to the axis of the keys, and that all the key openings in the coin-deposit locks belonging to said systems have a complementary axial-symmetrical shape.

9. Coin-deposit lock according to, claim 8 characterized in that the first key opening (6) is adapted to prevent foreign bodies, especially coins, from being jammed or wedged therein.

* * * * *

UNITED STATES PATENT AND TRADEMARK OFFICE

CERTIFICATE OF CORRECTION

PATENT NO. : 5,495,930

DATED : March 5, 1996

INVENTOR(S) : Aage Lenander and Bertil Engström

It is certified that error appears in the above-indentified patent and that said Letters Patent is hereby corrected as shown below:

Title page, correct the spelling of the second inventor's name, to the following: Bertil Engström Column 6, line 37, change "i" to --l--.

Signed and Sealed this

Twenty-first Day of May, 1996

Bruce Lehman

*Attest:*

BRUCE LEHMAN

*Attesting Officer*

*Commissioner of Patents and Trademarks*